US008109511B2

(12) United States Patent
Seike et al.

(10) Patent No.: US 8,109,511 B2
(45) Date of Patent: Feb. 7, 2012

(54) PAPER DISCHARGER AND IMAGE FORMING APPARATUS

(75) Inventors: Toshihiko Seike, Osaka (JP); Takashi Kubo, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 89 days.

(21) Appl. No.: 12/824,583

(22) Filed: Jun. 28, 2010

(65) Prior Publication Data

US 2010/0327522 A1 Dec. 30, 2010

(30) Foreign Application Priority Data

Jun. 29, 2009 (JP) ..... 2009-153815

(51) Int. Cl.
*B65H 29/00* (2006.01)

(52) U.S. Cl. ..... 271/279

(58) Field of Classification Search ..... 271/279, 271/280, 207, 302, 303, 287; 399/110, 121, 399/124, 125; 74/397, 405, 406; 192/20, 192/21, 41 R–41 A; 347/104
See application file for complete search history.

(56) References Cited

U.S. PATENT DOCUMENTS 5,162,845 A * 11/1992 Ariyama et al. ..... 399/13
5,897,237 A * 4/1999 Kono ..... 399/18

FOREIGN PATENT DOCUMENTS

JP 5-294531 A 11/1993
JP 2001-97627 * 4/2001
JP 2002-068569 A 3/2002
JP 2003-131450 * 5/2003
JP 2007-55706 A 3/2007

* cited by examiner

*Primary Examiner* — Gerald McClain
*Assistant Examiner* — Thomas Morrison
(74) *Attorney, Agent, or Firm* — Birch, Stewart, Kolasch & Birch, LLP

(57) ABSTRACT

A paper discharger is configured so as to perform paper conveying process to a first stacking tray and paper conveying process to a second stacking tray by a driving force from a single motor capable of reversible rotation in both directions. An image forming apparatus includes a movable door configured so as to support the second stacking tray, and a second gear train. Between a group of gears configuring the second gear train and a discharge roller is disposed a one way clutch configured so as to transmit driving force to the discharge roller only in the direction of discharging paper to the second stacking tray.

2 Claims, 6 Drawing Sheets

RELATED ART

PAPER DISCHARGER AND IMAGE FORMING APPARATUS

CROSS REFERENCE

This Nonprovisional application claims priority under 35 U.S.C. §119(a) on Patent Application No. 2009-153815 filed in Japan on Jun. 29, 2009, the entire contents of which are hereby incorporated by reference.

BACKGROUND OF THE INVENTION

The present invention relates to a paper discharger and an image forming apparatus that are configured so as to perform paper conveying process to a first stacking tray and paper conveying process to a second stacking tray by a driving force from a single motor capable of reversible rotation in both directions.

In an image forming apparatus, paper is conveyed to a stacking tray by a plurality of conveyor rollers. To the plurality of conveyor rollers, driving force is supplied ordinarily by a motor as driving source via a gear train as power transmission mechanism.

Here, among conventional gear trains are those configured so as to be divisible in the middle. For example, for a gear train supplying driving force to the conveyor rollers that are included in a movable unit capable of attachment and detachment, it is necessary to be configured so as to be divisible with the movement of the movable unit.

Then, among the apparatus employing such a gear train that is divisible as stated above, as shown in Japanese Patent Unexamined Publication No. 2007-055706 bulletin, there have been those employing a structure to absorb positional deviation that is attributed to the division, by supporting a gear disposed at the division point with a swingable arm.

In the case where a swingable arm according to the above-mentioned Patent literature is employed, it has been often that direction of the rotation is designed in order that, when the gear supported by the swingable arm rotates together with the other gear engaged therewith, the swingable arm hardly comes apart from the gear.

However, in circumstances where it is required to rotate a gear supported by the swingable arm in both directions, it is unavoidable to rotate the gear supported by the swingable arm in the direction whereby the swingable arm is apt to come apart from the gear engaged therewith. Therefore, the swingable arm has occasionally been likely to shake with the rotation of the supported gear, causing malfunction such as tooth jump of the gear and emission of abnormal sound. Namely, it may be said that in a configuration, for example, so as to convey paper to a plurality of stacking trays by driving force from a single driving source, because it is necessary to change the direction of rotation of a gear train appropriately, the aforementioned malfunction is prone to occur.

In order to get rid of such a deficiency, it is possible to have a configuration in which separate driving forces are provided from separate driving sources for respective sides of a division point of a gear train; however, employing such a configuration would require an additional driving source, thereby resulting in a complicated configuration, and hence an increased cost.

The present invention is directed to providing, with a simple configuration, a paper discharger that is capable of effectively suppressing occurrence of tooth jump at a division point in a gear train, even when the gear train that is divisible is rotated reversibly in both directions, and an image forming apparatus.

SUMMARY OF THE INVENTION

A paper discharger according to the present invention is configured so as to perform paper conveying process to a first stacking tray and paper conveying process to a second stacking tray by a driving force from a single motor that is capable of reversible rotation in both directions. The paper discharger comprises, at least, a door that is supplied to a housing so as to support the second stacking tray, and a gear train.

The gear train is configured so as to drive a paper discharge roller that discharges paper to the second stacking tray by a driving force from a motor, and so as to be divisible on opening of the door. Further, the gear train comprises a swingable arm to support a gear that is disposed at a division point and moves together with the door. Moreover, between the gear train and the discharge roller, a one way clutch is installed that is configured so as to transmit the driving force to the discharge roller only in the direction of discharging paper to the second stacking tray.

In this configuration, the gear train is divided when the door is opened and closed, and in the driving configuration in which the direction of rotation via the drive transmission is reversible, the one way clutch configuration is employed in between the gear train and the discharge roller that gives rise to a rotational load at the time of reversion. As a result, when the direction of rotation via the drive transmission is reversed, the driving load attributed to the discharge roller becomes almost zero, and thus tooth jump of the gear that would have been caused by shaking of the swingable arm at the division point of the gear train is prevented from occurring.

By the present invention, it is enabled, with a simple configuration, to effectively suppress the occurrence of tooth jump at the division point of the gear train, even when the divisible gear train is reversibly rotated in both directions.

DETAILED DESCRIPTION OF THE INVENTION

Figure 1:
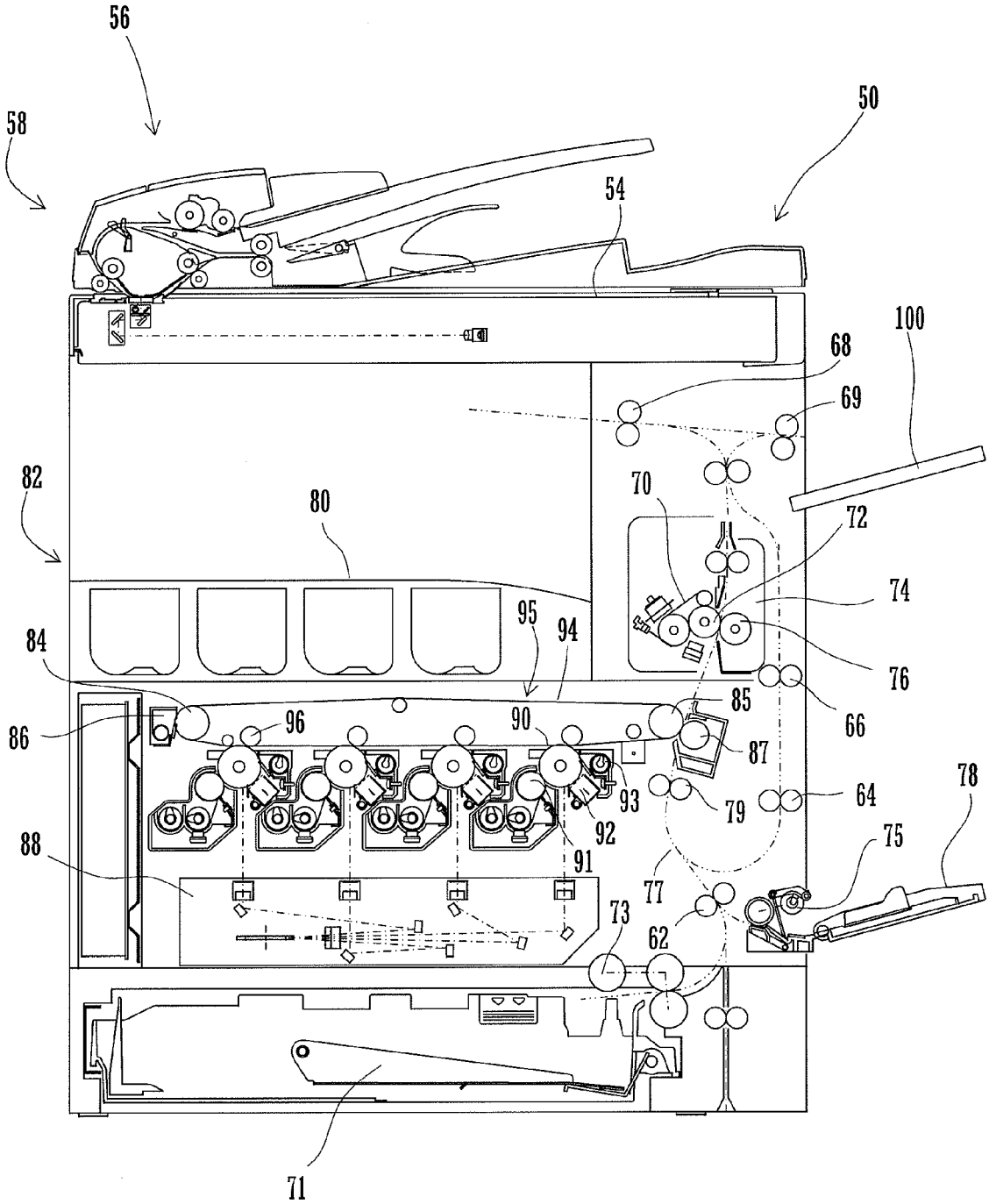
FIG. 1 is a drawing showing an outline configuration of an image forming apparatus according to an embodiment of the present invention.

FIG. 1 is a drawing showing an outline of an image forming apparatus 50 according to an embodiment of the present invention. The image forming apparatus 50, which forms a multicolor and/or monochromatic image onto a predetermined sheet of paper (recording paper) depending on the image data that have been transmitted from outside, comprises an image forming section 82 and a document reading section 58.

The image forming section 82 comprises four image forming stations that form black (K), cyan (C), magenta (M), and yellow (Y) color images, respectively. Each image forming station comprises a developing device 91, a photoreceptor drum 90, a cleaner unit 93 and an electrifier 92.

The image forming section 82 further comprises an optical scanner 88, an intermediate transfer belt unit 95, a fuser unit 74, a paper cassette 71, a first stacking tray 80, a second stacking tray 100, a plurality of flappers (illustration omitted) to switch direction of conveying paper, etc.

Above the image forming section 82 is installed a document table 54 made of a transparent glass on which a document is placed, and to the upper side of the document table 54 is attached an automated document processing unit 56. The automated document processing unit 56 conveys a document onto the document table 54 automatically. Additionally, the automated document processing unit 56 is configured so as to swing freely, and thus allows for manual placement of a document when the upper part of the document table 54 is opened.

The electrifier 92 is a charging means in order to charge the surface of the photoreceptor drum 90 uniformly at a predetermined electrostatic potential, and other than a non-contact type electrifier as shown in FIG. 1, a contact type electrifier of such as roller, brush or otherwise may be used occasionally.

The optical scanner 88 is configured so as to form an electrostatic latent image on the surface of each photoreceptor drum 90 based on the inputted image data.

Each developing device 91 makes the electrostatic latent image formed on corresponding photoreceptor drum 90 a developed image with a four-colored toner. Additionally, the cleaner unit 93 removes and collects the toner remaining on the surface of the photoreceptor drum 90 after a transfer process.

The intermediate transfer belt unit 95 disposed above the photoreceptor drum 90 comprises an intermediate transfer belt 94, an intermediate transfer belt drive roller 85, an intermediate transfer belt compliance roller 84, four intermediate transfer rollers 96, and an intermediate transfer belt cleaning unit 86.

The intermediate transfer belt drive roller 85, intermediate transfer belt compliance roller 84, and intermediate transfer roller 96 are configured so as to suspend the intermediate transfer belt 94 in a tensioned condition. In addition, each intermediate transfer roller 96 is configured so as to transcribe a toner image of the corresponding photoreceptor drum 90 onto the intermediate transfer belt 94.

The intermediate transfer belt 94 is installed so as to come into contact with each photoreceptor drum 90, and performs a function to form onto the intermediate transfer belt 94 color toner images (multicolor toner images) by transcribing the toner images of each color formed on the photoreceptor drums 90 onto the intermediate transfer belt 94 through a sequential superimposition. The intermediate transfer belt 94 is made up in an endless shape using a film, for example, of around 100 μm-150 μm in thickness.

When transfer of the toner image from the photoreceptor drum 90 onto the intermediate transfer belt 94 is performed, a high voltage transfer bias (a high voltage of reverse polarity (+) with respect to the electrostatic charge polarity (−) of the toner) is applied to the intermediate transfer roller 96 in order to transcribe the toner image. The intermediate transfer roller 96 is a roller based on a metal (e.g. stainless steel) shaft with a diameter of 8-10 mm and of which surface is covered by an electrically conductive elastomer (e.g. EPDM, urethane foam, etc.). With the electrically conductive elastomer, a high voltage can be applied uniformly to the intermediate transfer belt 94. Although roller geometry is used as a transfer electrode in this embodiment, other transfer electrodes of such as brush geometry or otherwise may be used.

The electrostatic images that have been developed on each photoconductor drum 90 in response to each hue as aforementioned are superimposed by the intermediate transfer belt 94. In this manner, with the rotation of the intermediate transfer belt 94, the superimposed image information is transcribed onto paper by an undermentioned secondary transfer roller 87 disposed at the position where the paper comes into contact with the intermediate transfer belt 94.

At this time, the intermediate transfer belt 94 and the secondary transfer roller 87 are pressure contacted with a predetermined nip, and a voltage for transcribing the toner onto paper is applied to the secondary transfer roller 87 (a high voltage of reverse polarity (+) with respect to the electrostatic charge polarity (−) of the toner). Further, so as to constantly obtain the above-mentioned nip, either of the secondary transfer roller 87 or the intermediate transfer belt drive roller 85 is made of a rigid material (a metal, etc.), and an elastic roller made of such as a flexible material (an elastic rubber roller or foam resin roller, etc.) is employed to the other.

Also, because the toner, which adhered to the intermediate transfer belt 94 when the intermediate transfer belt 94 came into contact with the photoreceptor drum 90 as mentioned above, or which remained on the intermediate transfer belt 94 when transfer therefrom had not been made onto paper by the secondary transfer roller 87, causes color mixture of the toner in the next step, an intermediate transfer belt cleaning unit 86 is set up so as to remove and collect the toner. To the intermediate transfer belt cleaning unit 86, a cleaning blade, for example, is mounted as a cleaning member that comes into contact with the intermediate transfer belt 94, and the intermediate transfer belt 94 which the cleaning blade comes into contact with is supported by the intermediate transfer belt compliance roller 84 from backside.

A paper cassette 71 is a tray to store paper (recording sheets) to be used for image formation, and is installed in the lower side of the optical scanner 88 of the image forming section 82. Besides, paper to be used for image formation can be placed onto a hand-fed paper cassette 78.

Further, the first stacking tray 80 is installed in the upper side of the image forming section 82, and it is configured such that sheets of paper that are finished with printing accumulate with their printed face facing downwards. On the other hand, the second stacking tray 100 is disposed outside the housing of the image forming device 50, and it is configured such that sheets of paper that are finished with printing accumulate with their printed face facing upwards.

Also, in the image forming section 82, a paper conveying path 77 of generally vertical shape is provided so as to transmit paper of the paper cassette 71 and the hand-fed paper cassette 78, by way of the secondary transfer roller 87 and the fuser unit 74, to the first stacking tray 80 or the second stacking tray 100. In the vicinity of the paper conveying path 77, which extends from the paper cassette 71 or the hand-fed paper cassette 78 to the first stacking tray 80 and the second stacking tray 100, are disposed pickup rollers 73, 75, a plurality of conveyor rollers 62, 64, 66, 68, a registration roller 79, a secondary transfer roller 87, a fuser unit 74, and so on.

The conveyor rollers 62, 64, 66, 68 are small rollers to facilitate and aid conveyance of paper, and a plurality of them are installed along the paper conveying path 77. Additionally, the pickup roller 73, which is installed in the vicinity of an edge of the paper cassette 71, supplies paper by picking it up piece by piece from the paper cassette 71 to the paper conveying path 77. Similarly, the pick-up roller 73, which is installed in the vicinity of an edge of the hand-fed paper cassette 78, also supplies paper by picking it up piece by piece from the hand-fed paper cassette 78 to the paper conveying path 77.

Then, the registration roller 79, which holds the paper temporarily while it is conveyed through the paper conveying path 77, performs a function to convey paper to the secondary transfer roller 87 with a timing that adjusts the leading edge of toner image on the photoreceptor drum 90 to the leading edge of the paper.

The fuser unit 74 comprises a heating roller 72 and a pressure roller 76, and the heating roller 72 and pressure roller 76 are configured so as to rotate holding the paper between them. Then the heating roller 72 is set by the control section to a predetermined fusing temperature, based on the signal from a temperature sensor which is not illustrated. The heating roller 72, together with the pressure roller 76, performs function of heat fusing on paper by means of the thermo-compression bonding of toner onto the paper, and hence through fusing, mixing and pressure-contacting transcribed multicolor toner images to the paper. Also provided is an external heating belt 70 for heating the heating roller 72 from outside.

Subsequently, a detailed description of the paper conveying path follows. As described above, the image forming apparatus comprises a paper cassette 71 for receiving paper in advance, and a hand-fed paper cassette 78. To perform feed of paper from these paper cassettes 71, 78, the pick-up rollers 73, 75 are disposed respectively so as to lead the paper piece by piece to the conveying path 77.

The paper conveyed from each of paper cassettes 71, 78 is conveyed to the registration roller 79 by the conveyor roller 62 of the paper conveying path 77. Then the paper is conveyed to the secondary transfer roller 87 with a timing that adjusts the front edge of the paper to the front edge of image information on the intermediate transfer belt 94, whereby the image information is written on the paper. Subsequently, the paper, after passing through the fuser unit 74, thereby pre-fused toner on the paper thermally fused and fixed, and then traveling via the conveyor roller 68 that is disposed downstream, is discharged to the first stacking tray 80 or the second stacking tray 100.

The aforementioned conveying path is one which is provided for single sided printing on paper. In contrast, in the case of duplex printing, the paper that has been finished with a single sided printing and has passed the fuser unit 74 as described above is held at the rear edge thereof by the final conveyor roller 68. After that, the rotation of the conveyor roller 68 is reversed and the position of the flapper (illustration omitted) is switched, whereby the paper is led to the return conveying path in which the conveyor rollers 66 and 64 are disposed. The paper, from the return conveying path via the registration roller 79, reaches the contact position with the intermediate transfer belt 94, where a printing is performed on its rear face. Then the paper is discharged to the first stacking tray 80.

Figure 2:
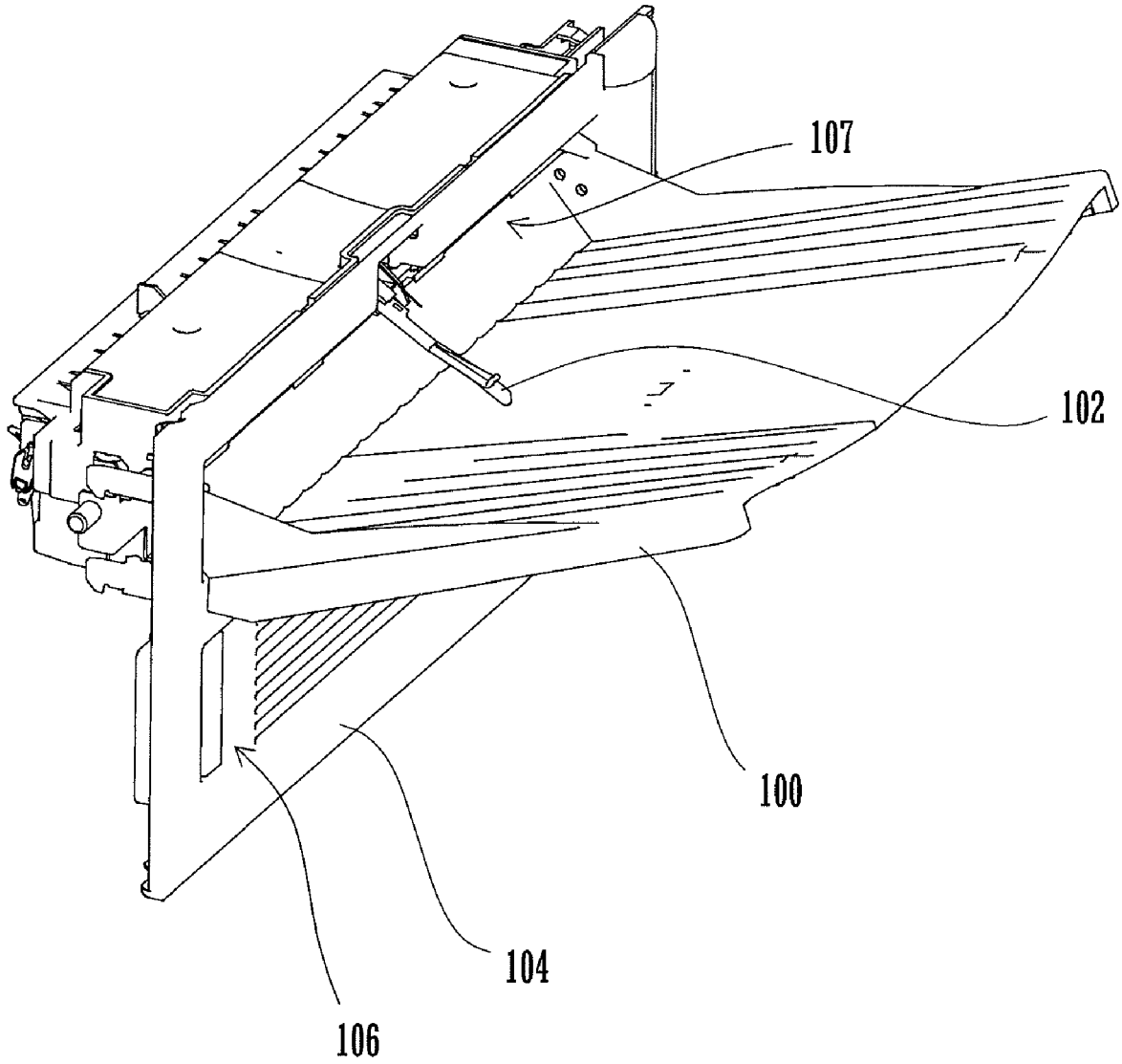
FIG. 2 is a drawing showing an outline configuration of a second stacking tray.

FIG. 2 shows an outline configuration of the second stacking tray 100. As shown in the figure above, the second stacking tray 100 is installed outside a door 104 configuring part of the housing of the image forming apparatus 50, and is disposed below a discharge port 107 formed on the door 104. Above the second stacking tray 100 is mounted a paper sensor 102 to detect the state at which the second stacking tray 100 is loaded with full sheets of paper. A handle 106 is attached to the door 104, and a user, by opening the door with the handle 106, can expose outwards part of the interior of the image forming apparatus 50.

Figure 3:
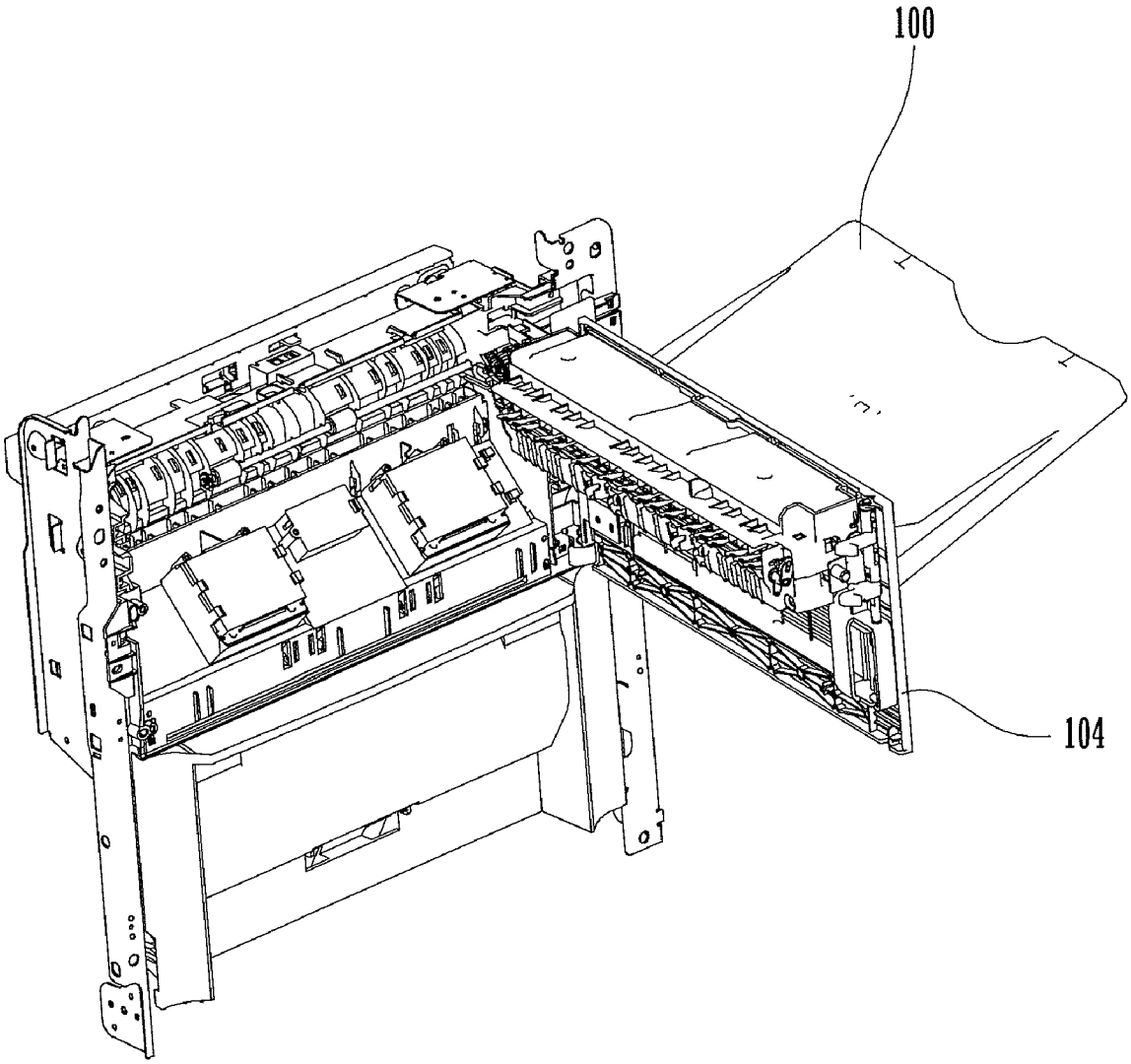
FIG. 3 is a drawing showing one side of the housing of the image forming apparatus in a state when the door is opened.

FIG. 3 shows a state of one side of the housing of the image forming apparatus 50 when the door 104 is opened. The door 104 is configured so as to rotate around a shaft that is extending in vertical direction and installed at the backside of the image forming apparatus 50. For example, when a jam occurred with the paper that had passed the fuser unit 74, a user can remove the paper involved in the jam by opening the door 104. In this embodiment, although a configuration is employed such that the door 104 is opened by pulling the door 104 backwards to the right, and that the door 104 is closed by returning the door 104 forward to the left, embodiment of opening and closing of the door 104 is not limited as such.

Figure 4:
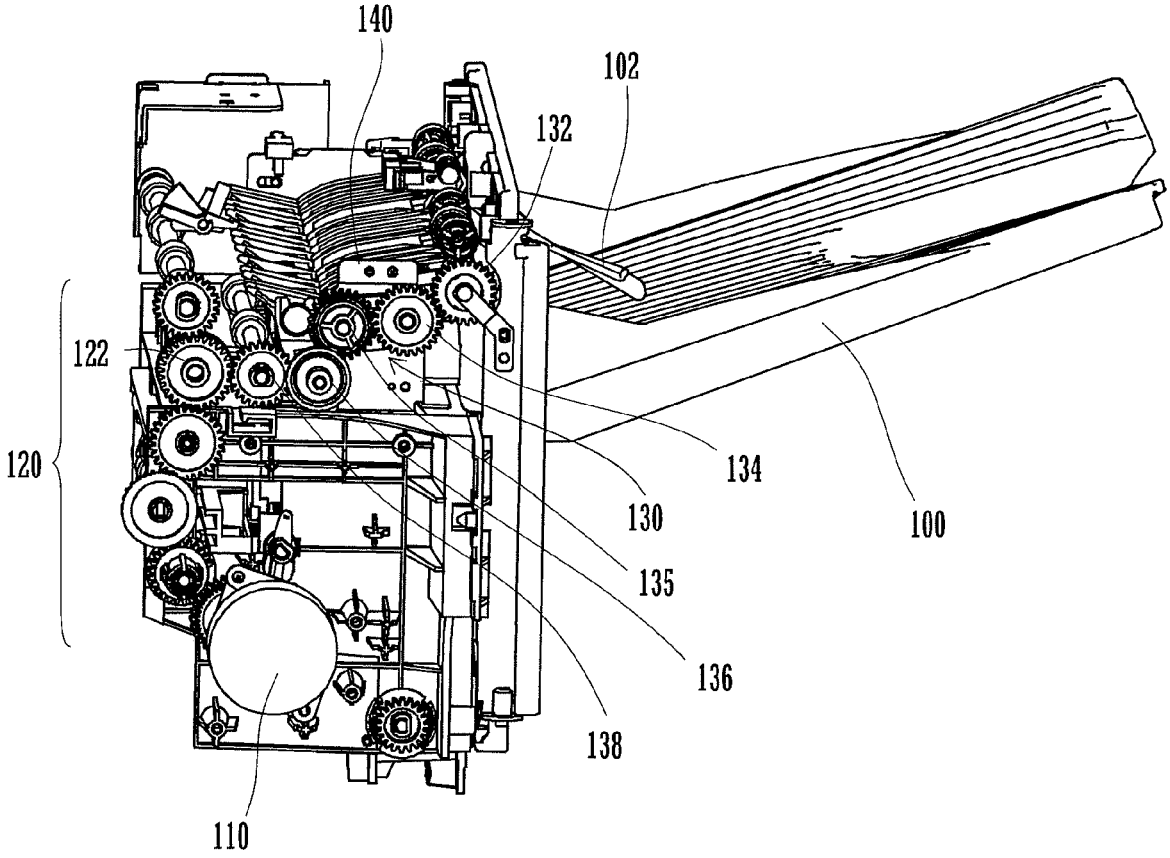
FIG. 4 is a drawing showing a configuration of a driving system that conveys paper to a first stacking tray and the second stacking tray.

FIG. 4 shows a configuration of the driving system to convey paper to the first stacking tray 80 and the second stacking tray 100. Here, in order to simplify configuration of the driving system, a configuration is employed in which conveyance of the paper which has passed the fuser unit 74 is performed solely by the driving force from a single motor 110.

The motor 110 is configured so as to reversibly rotate in both directions. The motor 110, as shown in FIG. 4, is connected to a first gear train 120 configured so as to drive a group of rollers which convey paper to the first stacking tray 80. The first gear train 120 is connected to a second gear train 130 via a gear 122. The second gear train 130 is configured so as to drive a group of rollers which convey paper to the second stacking tray 100, and comprises five gears 132, 134, 135, 136 and 138. The second gear train 130 is also configured so as to be divisible with the opening of the door 104. Here, the second gear train 130 is configured so as to be divided between a gear 136 and gear 135 when the door 104 is opened.

The gear 135 is supported by a rocker arm 140. The rocker arm 140 is configured, even when division of the second gear train 130 is caused to occur, so as to absorb misalignment of the gears 136 and 135 between which the division point occurs.

Figure 5A:
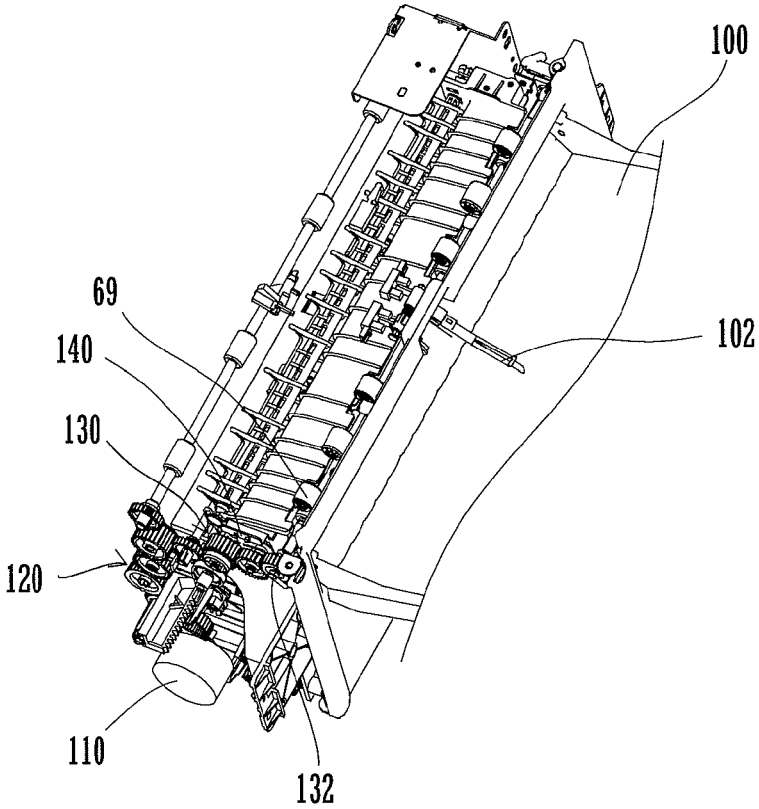
FIGS. 5A and 5B are drawings showing outline configurations of a second gear train.
Figure 5B:
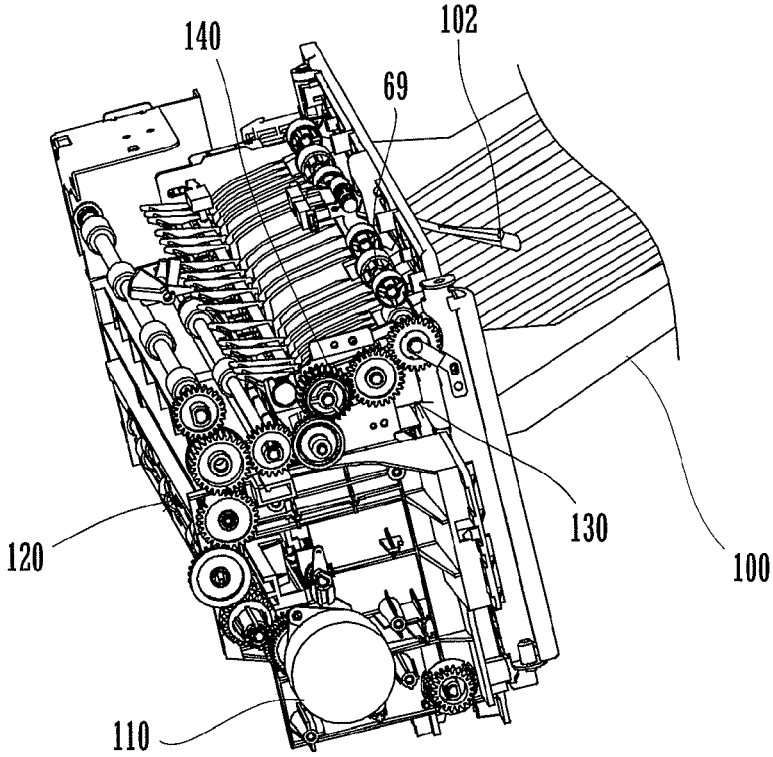

Subsequently, using FIG. 5A and FIG. 5B, configuration of the second gear train 130 is explained further. As shown in the figures above, the conveyor roller 69 to convey paper to the first stacking tray 100 is connected to the gear 132 that is disposed most downstream in the second gear train 130. In this embodiment, because the gear 132 is connected to the upper side conveyor roller 69, when the gear 132 rotates counterclockwise in the figures, the conveyor roller 69 rotates in the direction of discharging paper onto the second stacking tray 100.

Subsequently, movement of the second gear train 130 is explained, using FIG. 6A through FIG. 6D.

Figure 6A:
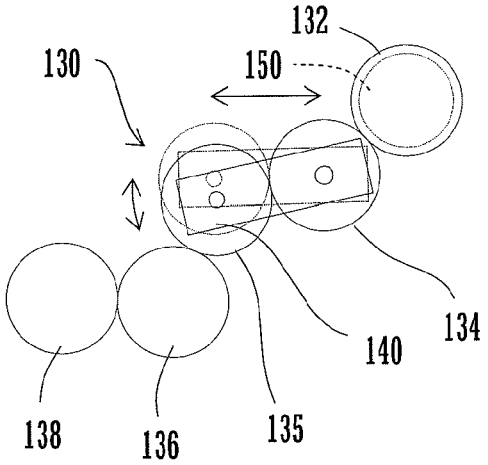
FIGS. 6A through 6D are drawings explaining operations of the second gear train.

As shown in FIG. 6A, the opening movement of the door 104 causes the rocker arm 140 to be lifted, and engagement state with one another of the gear 135 and gear 136 to be released. Also, closing the door 104 causes the gear 135 and gear 136 again to come to the engagement state with each other, and causes the driving force from the motor 110 to be transmitted to the gear 132.

Here, in this embodiment, a one way clutch 150 for transmitting a rotatory force only counterclockwise (in the direction of discharging paper onto the second stacking tray 100) to the conveyor roller 69 is provided between the gear 132 and the conveyor roller 69. The reason for providing the one way clutches 150, as will be described below, is to prevent tooth jump from occurring (see FIG. 6D) at the division point between the gears 135 and 136 of the second gear train 130 when paper is discharged to the first stacking tray 80.

Figure 6B:
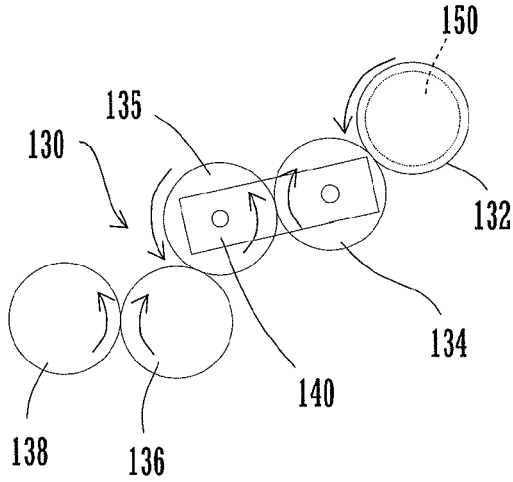

FIG. 6B shows movement of the second gear train 130 when paper is discharged to the second stacking tray 100. Here, because the gear 136 rotates in the direction of attracting the rocker arm 140 to the gear 136, the rocker arm 140 will not rise with the rotation of the gear 136, so that tooth jump will not occur between the gear 135 and gear 136.

Figure 6C:
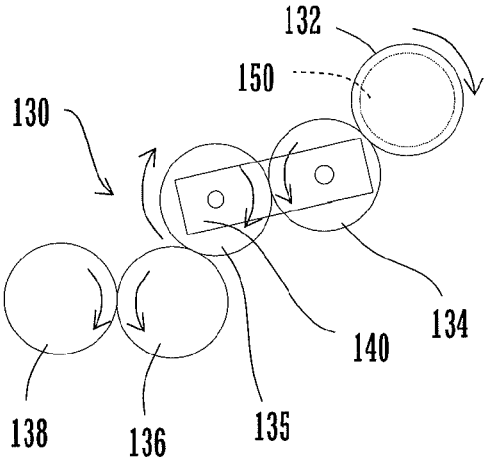

FIG. 6C shows movement of the second gear train 130 when paper is discharged to the first stacking tray 80. Here, the gear 136 rotates in the direction in which the rocker arm 140 is apt to come apart from the gear 136. However, because the one way clutch 150 for transmitting the drive to only one direction (direction to discharge paper to the second stacking tray 100) is employed in between the gear 132 and conveyor roller 69 as a load section, driving load at the time of reversion is almost free of load. Therefore, the gear 135, gear 134 and gear 132 rotate, accompanying the rotation of the gear 136, in a state of nearly free of load, so that the rocker arm 140 is hardly caused to rise by the rotation of the gear 136. As a result, tooth jump between the gear 135 and gear 136 is suppressed, and emission of abnormal sound resultant therefrom is also prevented. For instance, shown in FIG. 6D is an illustration in which a one way clutch 150 is not employed; in this case, the rocker arm 140 rises with the rotation of the gear 136, thereby tooth jump occurs between the gear 135 and gear 136, and abnormal sound occurs due to clash of these gears.

Figure 6D:
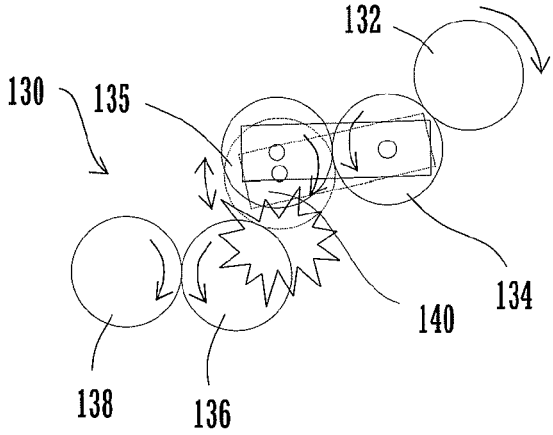

By employing a configuration according to an embodiment of the present invention, such a malfunction as shown in FIG. 6D is prevented from occurring when paper is discharged to the first stacking tray 80. Thereby it is also capable of preventing, at the same time, occurrence of such a malfunction that causes the paper on the second stacking tray 100 being caught by the conveyor roller 69 rotating in reverse direction when the paper is discharged to the first stacking tray 80.

By the foregoing configuration, while cost reduction is attempted by implementing a gear layout with a small number of motors, tooth jump at the division point of the second gear train 130 that is reversibly rotated in both directions can effectively be prevented from occurring.

The above explanation of the embodiment is nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. A paper discharger configured so as to perform a paper conveying process to a first stacking tray and a paper conveying process to a second stacking tray by a driving force from a single motor capable of reversible rotation in both directions, the paper discharger comprising:

a door supplied to a housing so as to support the second stacking tray, and a gear train configured so as to drive a paper discharge roller for discharging paper to the second stacking tray by the driving force from the motor, the gear train being configured to be divisible on opening of the door, wherein the gear train includes a swingable arm for supporting a gear that is disposed at a division point and that moves together with the door; and wherein a one way clutch is provided between the gear train and the discharge roller, the one way clutch being configured so as to transmit the driving force to the discharge roller only in the direction of discharging paper to the second stacking tray.

2. An image forming apparatus comprising the paper discharger of claim 1.

* * * * *